United States Patent [19]

Montgomery et al.

[11] Patent Number: 4,995,128

[45] Date of Patent: Feb. 26, 1991

[54] ELECTRICIAN'S COMBINATION TOOL

[76] Inventors: Robert D. Montgomery, 1685 W. 12th, Reno, Nev. 89503; Harold L. Hull, 401 Canyon Way, Sparks, Nev. 89434

[21] Appl. No.: 468,135

[22] Filed: Jan. 22, 1990

[51] Int. Cl.[5] ..... B25B 7/22

[52] U.S. Cl. ..... 7/127; 7/130

[58] Field of Search ..... 7/127, 129–130, 7/107; 81/438, 451

[56] References Cited

U.S. PATENT DOCUMENTS

| | | | |
|---|---|---|---|
| D. 255,539 | 6/1980 | Graham | D8/22 |
| D. 281,216 | 10/1985 | Cutliff, Jr. | D8/26 |
| D. 283,198 | 4/1986 | Sipotz | D8/105 |
| 1,293,966 | 2/1919 | Springer | 7/130 |
| 1,473,851 | 11/1923 | Hall | 7/127 X |
| 1,514,488 | 11/1924 | Wernimont | 7/130 |
| 3,007,504 | 11/1961 | Clark | 81/438 X |
| 3,525,107 | 8/1970 | Hays | 7/107 |
| 3,946,453 | 3/1976 | Torress | 7/4 |
| 4,114,482 | 9/1978 | Houdechell | 81/421 |
| 4,238,862 | 12/1980 | Leatherman | 7/128 |
| 4,244,067 | 1/1981 | Rowe | 7/127 X |
| 4,283,805 | 8/1981 | Stacy | 7/127 |
| 4,285,255 | 8/1981 | Winfrey | 81/451 |
| 4,337,542 | 7/1982 | Theiler | 7/107 |
| 4,477,937 | 10/1984 | Costello | 7/139 |
| 4,571,764 | 2/1986 | Chen | 7/107 |
| 4,660,241 | 4/1987 | Chen | 7/107 |
| 4,748,876 | 6/1988 | Solf | 81/341 |

FOREIGN PATENT DOCUMENTS

| | | | |
|---|---|---|---|
| 1015318 | 9/1952 | France | 7/127 |

*Primary Examiner*—James G. Smith

[57] ABSTRACT

A combination electrician's tool which is substantially a pair of pliers in which the handles are parallel to each other and having at one of it's handle ends a crescent wrench while the other handle end has means to accept various tips such as screwdriver tips, sockets, etc. and gripping means to put pressure on the tips and the other handle being turned crossways can act as a torque wrench. The tool also has cutting, stripping and crimping means and one of the jaw sections can engage and hold a slotted screw.

11 Claims, 4 Drawing Sheets

ELECTRICIAN'S COMBINATION TOOL

This invention relates to a combination tool and more particularly to a combination tool for the specific use by an electrician involved in the daily use of tools designed for this particular trade.

BACKGROUND OF THE INVENTION

In the past many combination tools have been taught for the use of a specific workman such as a mechanic, carpenter, plumber, etc. and some tools have been designed for the specific use of an electrician, however, with the evolution of the trade moving toward diversified parts such as junction boxes, conduit connections, varied wire sizes, grounding straps and many others, no tool, to the knowledge of the inventors, has been designed to cover most of the requirements of the working, professional electrician which can replace a number of tools now required in the trade such as special pliers, crimpers, cutters, strippers, screw drivers, special tips, sockets, etc.

For example, design U.S. Pat. No. 283,198 shows a combination pliers, crescent wrench and screwdriver, while U.S. Pat. No. 4,660,241 teaches a combination tool for wire stripping, cutting and terminal crimping, and U.S. Pat. No. 4,571,764 shows a double-sided pliers with a pair of handle bars, a body, a T member, a stripping cutter, terminal pressing member and shearing member.

These and other devices specialize in certain aspects of the trade but are still not as complete as is possible with the present invention, and many of them are expensive to manufacture as they have a number of separate, complicated parts.

SUMMARY OF THE INVENTION

In overcoming disadvantages of the prior art and in achieving other advantages, a special combination tool, designed with the professional electrician in mind and made in accordance with the present invention, includes a first and second plier member, each having a jaw section and handle section. The members are pivotably attached together to allow the jaws to move together in the convention manner. However, each plier member has distinct features which will be elaborated on and distinctly pointed out in the following objects and specifications.

It is therefore, a primary object of the present invention to provide a specialized tool designed to perform many of the functions necessary in the day to day work of a professional electrician.

It is a further object to include in the specialized tool a first and second plier member pivotably attached together, each having a jaw section and a handle section.

Another object is to provide in the tool, means to cut and strip wire.

Yet another object is to provide on the distal end of the first plier handle portion an adjustable crescent wrench.

Still another object is to provide on one end of the second plier handle a receptacle to receive a plurality of tools such as screwdriver tips, a swivel socket, varied socket sizes, and other specialized tips as required.

Also, another object is to provide at the distal end of one of the jaw members a special screw tip which surrounds a slotted screw head at the some time it engages the slotted screw head and keeps the tool from sliding off of the screw head, and this feature eliminates the general need for a special screwdriver.

Still another object is to provide a gripping area on one of the handles.

Still another object, in another embodiment, is to provide an independent gripping sleeve, which surrounds a section of one of the handles, which turns freely on the handle thus allowing a gripping area which when gripped with one hand, allows the other hand to grasp the second handle and use the device as a "speed wrench." This sleeve may be made of metal, rubber or vinyl or the like.

Yet another object is to provide means to partially lock the first and second plier members at substantially a 90 degree angle to each other when in an open position.

A further object is to provide crimping means.

Another object is to provide gripping section between the two plier members other than the jaw members to enable the workman to grasp a wire for stripping.

Another object is to provide a tool which can be formed in two pieces or can be fabricated.

Other objects and advantages will become obvious when taken in consideration with the following drawings.

BRIEF DESCRIPTION OF THE DRAWINGS

FIG. 4 is a section taken at a—a of FIG. a.

DETAILED DESCRIPTION OF THE DRAWINGS

Figure 1:
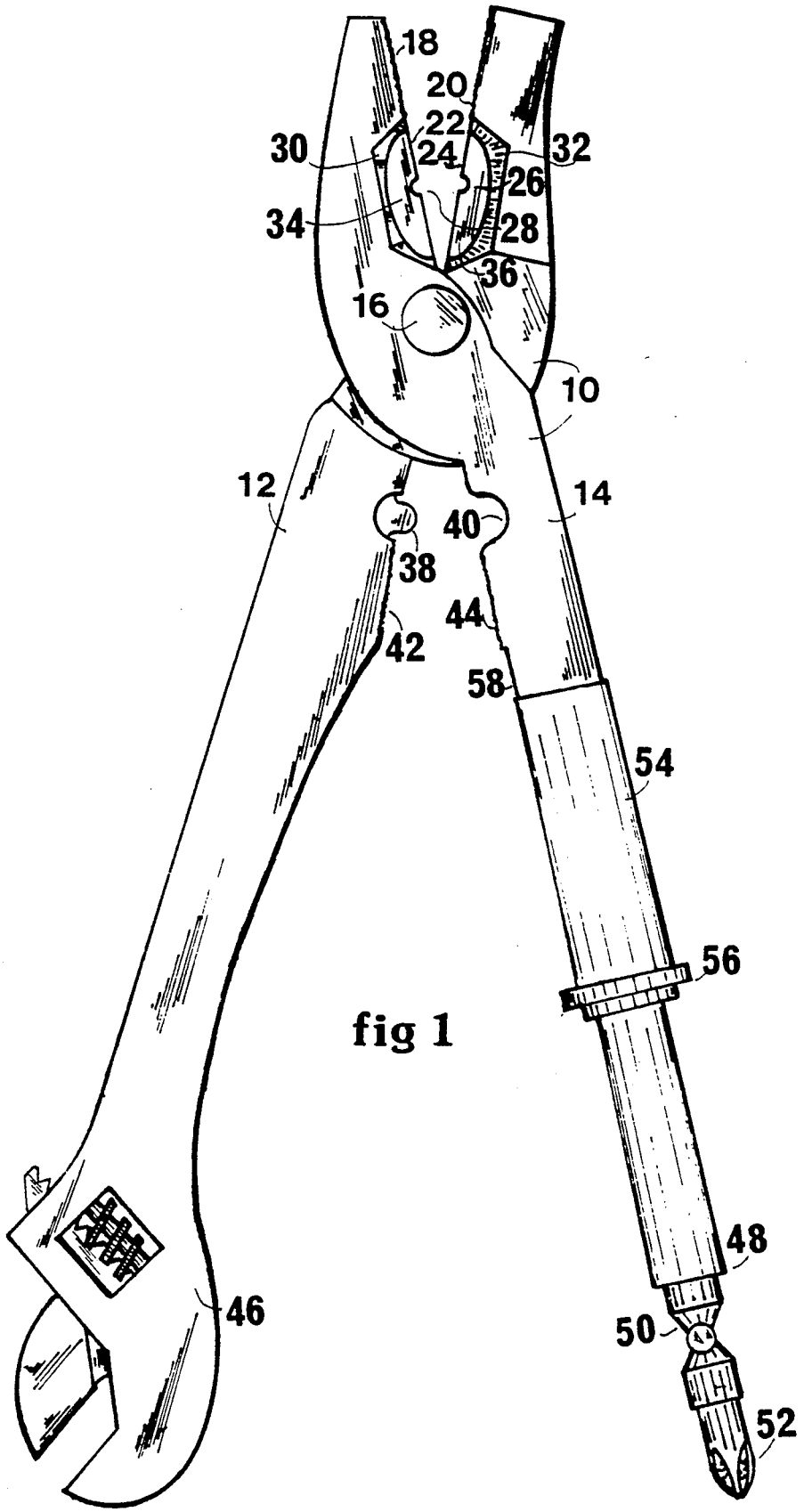
FIG. 1 is a side view.

Referring now to the drawings in detail wherein like numerals represent like parts throughout the various views, at FIG. 1 is depicted the preferred embodiment of an electrician's combination tool generally indicated by the number 10, and constructed in accordance with the present invention. The tool includes a pair of pivoted plier members, 12 and 14, joined together by pin 16, each of which include a conventional jaw section 18 and 20, respectively, and cutting edges, 22 and 24, respectively, and half circle cutting edges 26 and 28, respectively, for cutting insulation around a wire. Sections 30 and 32, respectively, are tapered sections leading to further tapered sections 34 and 36, respectively, which taper to the cutting edges 22 and 24 respectively.

Figure 2:
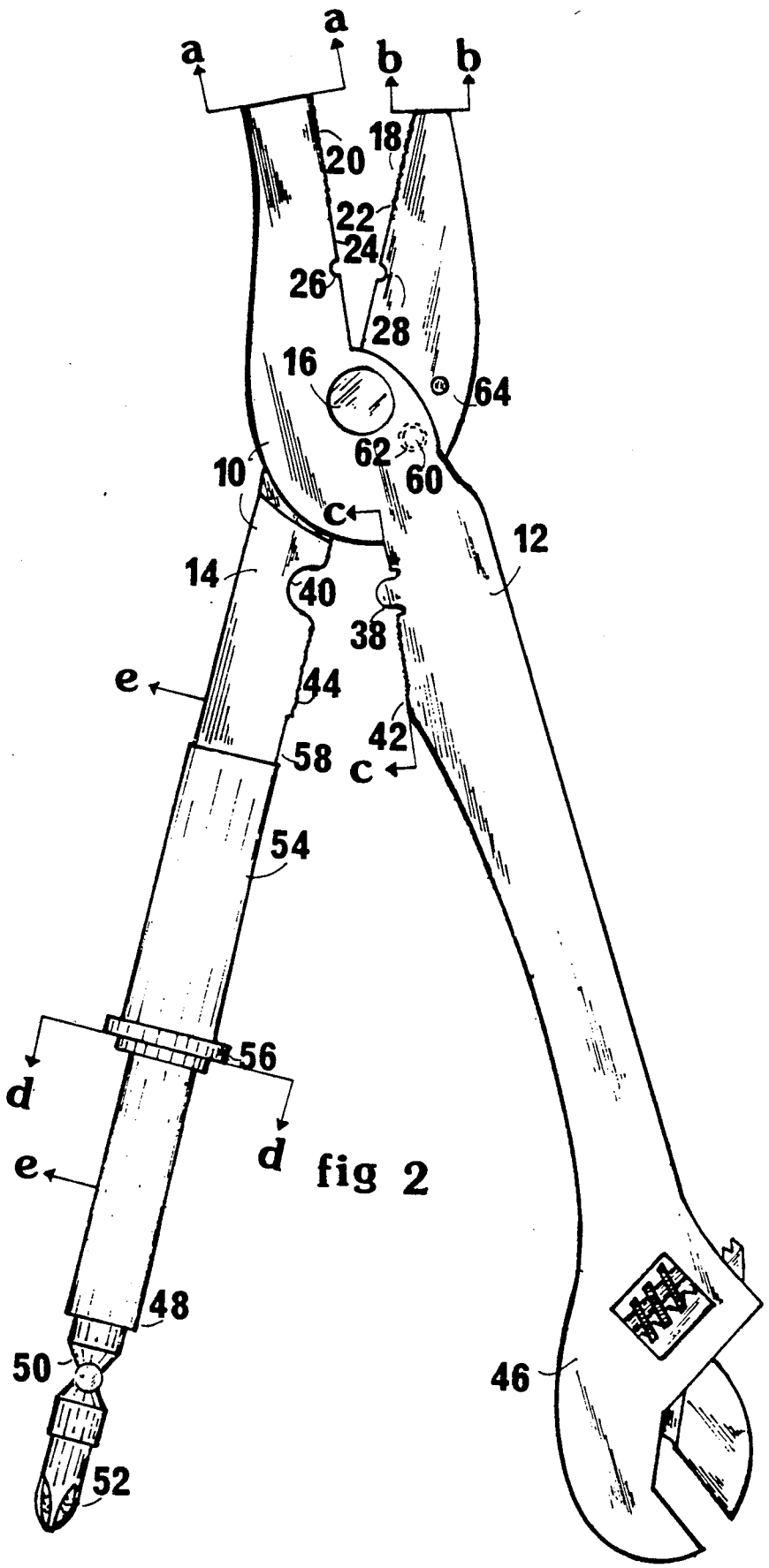
FIG. 2 is an opposite side view.
Figure 3:
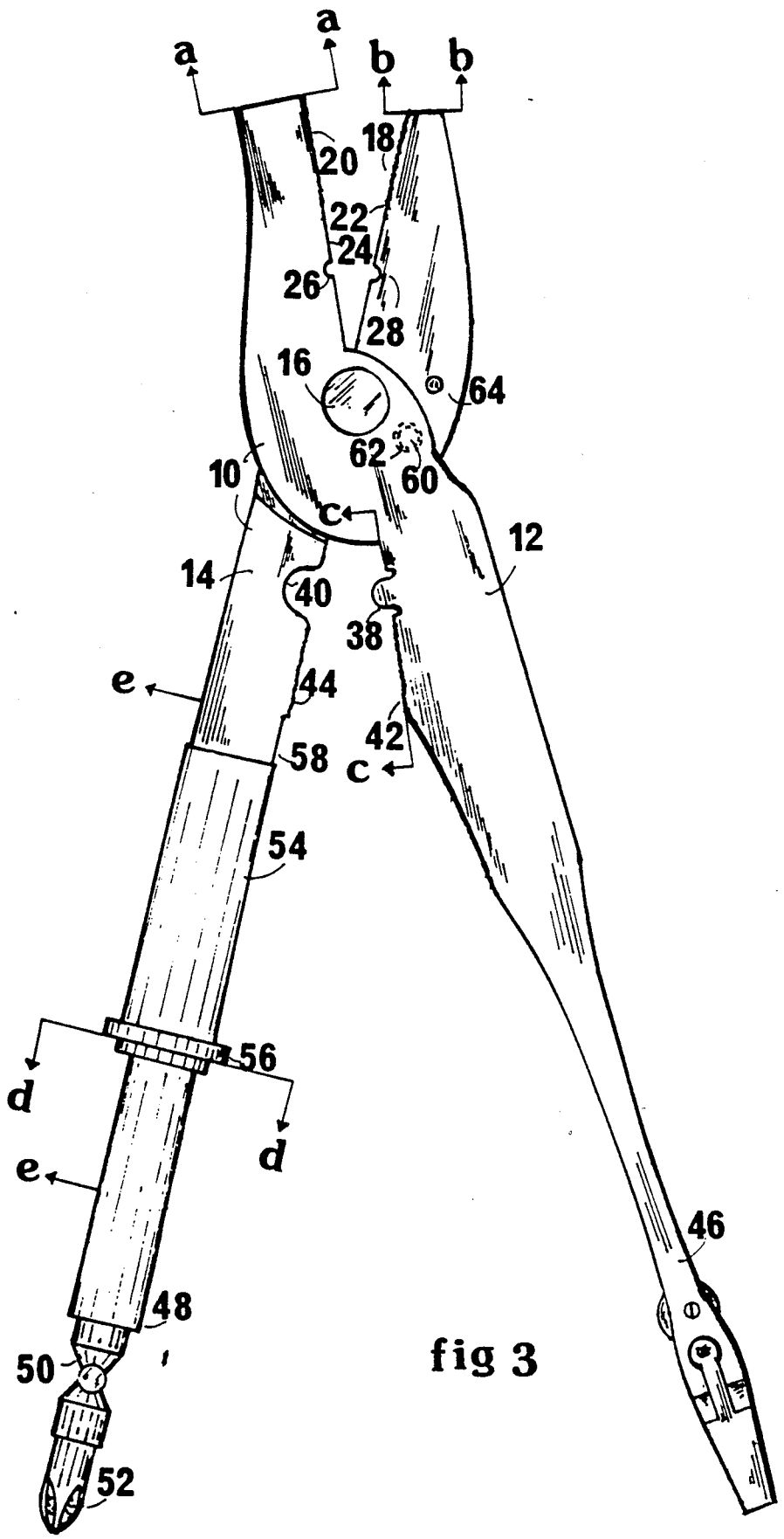
FIG. 3 is a side view of a second embodiment.
Figure 4:
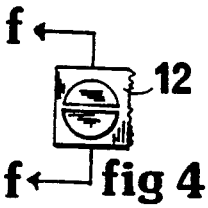
Figure 6:
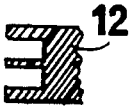
FIG. 6 is a section taken at f—f of FIG. 4.
Figure 5:
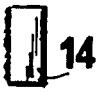
FIG. 5 is a section taken at b—b of FIG. 1.
Figure 7:
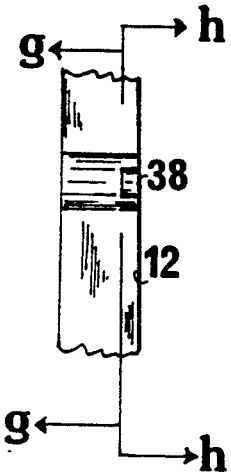
FIG. 7 is a section taken at c—c of FIG. 1.
Figure 8:
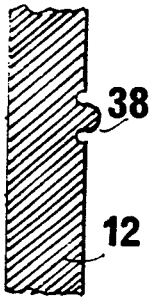
FIG. 8 is a section taken at g—g of FIG. 7.
Figure 9:
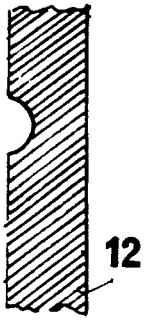
FIG. 9 is a section taken at h—h of FIG. 7.
Figure 10:
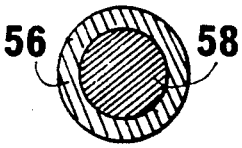
FIG. 10 is a section taken at d—d of FIG. 1.

It will be noted that the jaw section of member 14 is shorter than the jaw section 12 which allows the nd of the jaw section 12 (FIG. 4) to engage and surround a screw head (not shown), and the jaw section 14 being shorter allows the jaw section 14 to rotate freely around the screw head. 38 and 40 are mating parts of a crimping device while 42 and 44, respectively are a second pair of jaws for gripping and stripping a wire. The handle end of member 12 at it's distal end is a conventional crescent wrench 46 while the handle end of member 14 has a socket 48 at it's distal end to receive various assorted tips such as the swivel member 50 and the phillip's screw driver tip 52 as shown in FIG. 1 and FIG. 2.

Figure 12:
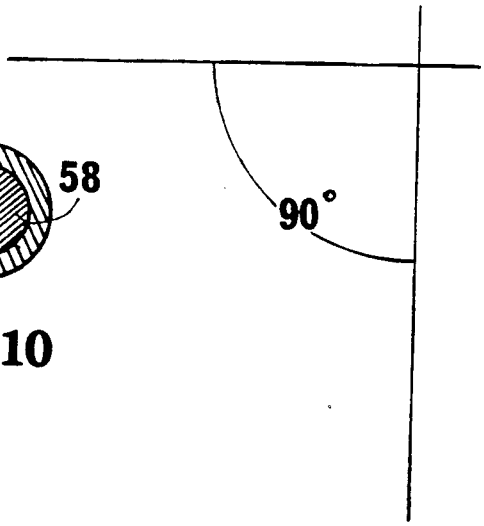
FIG. 12 is a conceptional diagram showing one member at substantially a right angle to second member.
Figure 11:
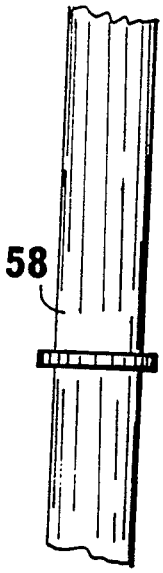
FIG. 11 is a section taken at e—e of FIG. 1.

54 is a cylinder with lip 56 which surrounds a shaft section 58 of the handle section of member 14 which is a gripping member which may be gripped with one hand (thumb and two fingers) in order to put pressure on and hold the engaging tip 52 against a work piece ( now shown), while the other hand grasps the second handle which may be used as a turning handle which gives more torque than a conventional screwdriver or the like. Also the tool may be used as a "speed wrench" when member 12 is held at a right angle to member 14 as illustrated in conceptional view FIG. 12, as the gripping member 54 with lip 56, are a loose fit and turn freely on shaft section 58. 60 is a spring loaded (spring not shown) ball bearing in a cavity 62 of member 12 while 64 is a recessed area in member 14 which accepts the ball bearing 60 when member 12 and member 14 are substantially at a 90 degree angle to each other, and partially locks them in an open position.

It will now be seen that we have provided a new and useful combination tool for an electrician or the like which may be used in his day to day work. The tool combines the usefulness of pliers, screwdrivers with changeable tips, a special tip on one of the jaw members for holding the tool on a slotted screw, wire stripping means, crimping means, cutting means, an adjustable crescent wrench, and means to firmly hold one of the members against the work piece while the tool becomes a "speed wrench".

Although the invention has been herein shown and described in what is conceived to be the most practical and preferred embodiment, it is recognized that departures may be made therefrom within the scope of the invention, which is not to be limited to the details disclosed herein but it is to be accorded the full scope of the claims so as to embrace any and all equivalent devices an apparatus.

Having described our invention, what we claim as new and desire to secure by letters patent is:

1. A combination tool comprising; a first and second plier member having a jaw section, said jaw sections having cutting edges, said cutting edges being aligned so that they coact to cut an object placed between them when said jaw sections are pivotally displaced toward and away from each other, said cutting edges having at least one notch, said notches being aligned so that they engage a wire placed between them when said jaw sections are pivotable displaced toward and away from each other, a first and second handle section, said handle sections having a first and second position, said plier members being pivotably attached together to allow said jaw section to be pivotably displaced toward and away from each other by moving said first and second handle sections to and away from each other, said handle sections being substantially parallel to each other when said handle sections are in a first closed position, said handle sections being at substantially a ninety degree angle to each other when said handle section are in said second open position, a gripping area, said gripping area being an independent cylinder surround a section of said first handle, said cylinder cooperating with said first handle section to allow said cylinder to turn freely on said first handle section, said gripping area cooperating with said first handle section to allow the thumb and fingers of a user to grasp said gripping area of said first handle section of said first plier member to put substantially pressure on the distal end of said first handle section, said first handle section having on it's distal end means to receive and hold releasable attached tips, said second plier member having on it's distal end a crescent wrench, said first and second handle sections having means between them to grasp a wire, and said first and second handle sections having means between them to crimp an electrical connector.

2. The device of claim 1 in which one of said jaw sections is longer than the other, said longer section comprising;

(a) a hollow extension in axial alignment thereto;
(b) said extension being a slot head driver cooperating with a fastener, said fastener having a slotted head;
(c) said extension of said driver including an elongated flat blade positioned therein such that the terminal edge of said blade is recessed a prescribed distance within said extension;
(d) said prescribed distance of said blade recession being so related to the thickness of said fastener head and the depth of said slot that when said blade is positioned in said slot, said member substantially encases said fastener head with terminal edge of said member positioned in a plane parallel to and intermediate of the upper and lower surfaces of said fastener head;
(e) whereby said member remains clear of the surface into which said fastener is being inserted.

3. The device of claim 1 in which said crescent wrench on said distal end of said second plier member is orientated with one of it's sides facing said first plier member.

4. The device of claim 1 in which said crescent wrench on said distal end of said second plier member is orientated with one of it's edges facing said first plier member.

5. The device of claim 1 in which said tips are slotted screwdriver tips.

6. The device of claim 1 in which said tips are phillips screwdriver tips.

7. The device of claim 1 in which said tips are socket wrenches.

8. The device of claim 1 in which means to receive and hold releaseably attached tips is magnetic.

9. The device of claim 1 in which means to receive and hold releaseably attached tips is mechanical.

10. The device of claim 1 in which said first and second plier members have means to partially lock them together when they are at substantially ninety degrees to each other.

11. The device of claim 10 in which said means to partially lock said first and second plier members together is a spring loaded ball being located in a recessed area of said first plier member, an indentation area in said second plier member, said indentation cooperating with said spring loaded ball bearing to partially hold and lock said first and second plier members when they are at substantially ninety degrees to each other.

* * * * *